United States Patent [19]

Wing

[11] 4,182,431

[45] Jan. 8, 1980

[54] COMBINATION EXTENSION AND STEP LADDER RUNGS THEREFOR

[75] Inventor: Harold R. Wing, Springville, Utah

[73] Assignee: Little Giant Industries Inc., American Fork, Utah

[21] Appl. No.: 885,837

[22] Filed: Mar. 13, 1978

[51] Int. Cl.[2] ..... E06C 1/18; E06C 1/32

[52] U.S. Cl. ..... 182/23; 182/167; 182/228

[58] Field of Search ..... 182/22, 23, 24, 228, 182/166, 167, 209, 207, 27

[56] References Cited

U.S. PATENT DOCUMENTS

| | | | |
|---|---|---|---|
| 745,320 | 12/1903 | Bruno | 182/167 |
| 3,085,651 | 4/1963 | Rich | 182/228 |
| 3,692,143 | 9/1972 | Kummerlin | 182/24 |

FOREIGN PATENT DOCUMENTS

| | | | |
|---|---|---|---|
| 2228045 | 12/1973 | Fed. Rep. of Germany | 182/167 |
| 1457149 | 12/1976 | United Kingdom | 182/228 |

*Primary Examiner*—Reinaldo P. Machado
*Attorney, Agent, or Firm*—H. Ross Workman; Rick D. Nydegger

[57] ABSTRACT

A combination step and extension ladder is disclosed. Hinges are provided on each of the side rails of the ladder so that the ladder may be folded and unfolded from a step ladder configuration to a straight extension ladder configuration and vice versa. Additional side rails are provided which are telescopically mounted so that the ladder can be extended to increase its height in either of the step ladder or extension ladder configurations. Each of the ladder rungs are provided with two flat stepping surfaces which are symmetrically angularly oriented with respect to the side rails of the ladder so that at least one of the surfaces of each rung will present an essentially horizontal stepping surface whenever the ladder is in an upright position, either as a step ladder or as an extension ladder, and irrespective of which end of the side rails the ladder is standing on.

1 Claim; 5 Drawing Figures

COMBINATION EXTENSION AND STEP LADDER RUNGS THEREFOR

BACKGROUND

1. Field of the Invention

The present invention relates to ladders and in particular to combination step and extension ladders which may be folded and unfolded from a step ladder configuration to a straight extension ladder configuration and vice versa.

2. The Prior Art

Ladders are commonly used for a variety of applications and are of two general types. One type is a folding ladder, commonly called a step ladder, which is self-supporting. Step ladders are typically used for such tasks as pruning, painting ceilings or other similar tasks where it may be imossible to lean the ladder against a structure for support. Step ladders typically have wide, flat rungs which enhance the stability and comfort when climbing or standing on the ladder.

The other type of ladder which is well known is the straight extension ladder. This type of ladder is simply leaned against a wall or some other structure when standing or climbing on the ladder. Such ladders often include an extensible segment which can be used to telescopically extend the length of the ladder as desired.

Ladders which are constructed so that they may be used as both step ladders and as straight extension ladders have long been known in the art. For example, see U.S. Pat. Nos. 594,303, 1,100,823 and 3,912,043. Typically, such ladders are constructed with hinges in the middle of the side rails. The hinges permit the ladder to be folded into a step ladder configuration or unfolded into a straight extension ladder configuration. As will be readily appreciated, such ladders (hereinafter designated "combination step and extension ladders") are very versatile and they combine the desirable features of both types of ladders.

However, combination step and extension ladders have presented problems with respect to the type of ladder rungs which may be used with such ladders. For example, one type of ladder rung which is often used with combination step and extension ladders is a dowel-shaped rung. See, e.g., U.S. Pat. No. 1,100,823. Dowel-shaped ladder rungs have the advantage of permitting the user to climb up either side of the ladder when it is used in the step ladder configuration. However, dowel-shaped rungs are much more difficult to climb or stand on than wide, flat rungs.

Combination step and extension ladders have also used wide, flat ladder rungs. See, e.g., U.S. Pat. No. 594,303. Typically, flat ladder rungs are angularly oriented with respect to the side rails so that when the ladder is leaned up against a wall or otherwise stood in the upright position, the flat rungs will present an essentially horizontal stepping surface. However, when folding a combination step and extension ladder having flat ladder rungs into the step ladder configuration, a user can only climb up one side of the step ladder since the ladder rungs on the other side will not present a horizontal stepping surface but will instead form an acute angle.

In order to avoid the problems mentioned with the types of ladder rungs described above, more recent combination step and extension ladders have used a combination of both flat ladder rungs and dowel-shaped rungs. See, e.g., U.S. Pat. No. 3,912,043. Thus, when folded into the step ladder configuration, a user may climb up either side of the step ladder, using either the side with dowel-shaped rungs or the side with flat rungs. Although this increases the versatility of a combination step and extension ladder, it will nevertheless be appreciated that in many applications the problems attendant with dowel-shaped rungs are not overcome with this type of ladder. Furthermore, when unfolded so as to be used as a straight extension ladder, the ladder must be stood on a particular end of the side rails to ensure that the flat ladder rungs will present a horizontal stepping surface.

It would therefore be an improvement in the art to provide a combination step and extension ladder having ladder rungs with flat stepping surfaces which are always essentially horizontally oriented regardless of which configuration the ladder is in and regardless of which end the ladder stands on. It would also be advantageous to provide a combination step and extension ladder which may be extended to increase the height of the ladder in both the straight extension ladder configuration and in the step ladder configuration.

BRIEF SUMMARY AND OBJECTS OF THE INVENTION

The combination step and extension ladder of the present invention provides a novel ladder rung which has two flat stepping surfaces. The flat stepping surfaces of each rung are symmetrically angularly disposed between the side rails of the ladder such that an essentially horizontal stepping surface is presented irrespective of whether the ladder is in the step ladder configuration or in the straight extension ladder configuration and also irrespective of which end of the side rails the ladder stands on. The combination extension and step ladder of the present invention may also be extended to increase its height either as a step ladder or as an extension ladder.

It is therefore a primary object of the present invention to provide an improved combination step and extension ladder.

Another primary object of the present invention is to provide an improved ladder rung having at least two flat stepping surfaces symmetrically oriented such that at least one of the stepping surfaces will present an essentially horizontal stepping surface regardless of whether the ladder is used in the step ladder configuration or the extension ladder configuration and regardless of which end of the side rails the ladder stands on.

Another important object of the present invention is to provide a combination step and extension ladder which is extensible in both the step ladder configuration and the extension ladder configuration.

These and other objects of the present invention will become more fully apparent from the following description and appended claims taken in conjunction with the accompanying drawing.

DETAILED DESCRIPTION OF THE PREFERRED EMBODIMENT

Figure 1:
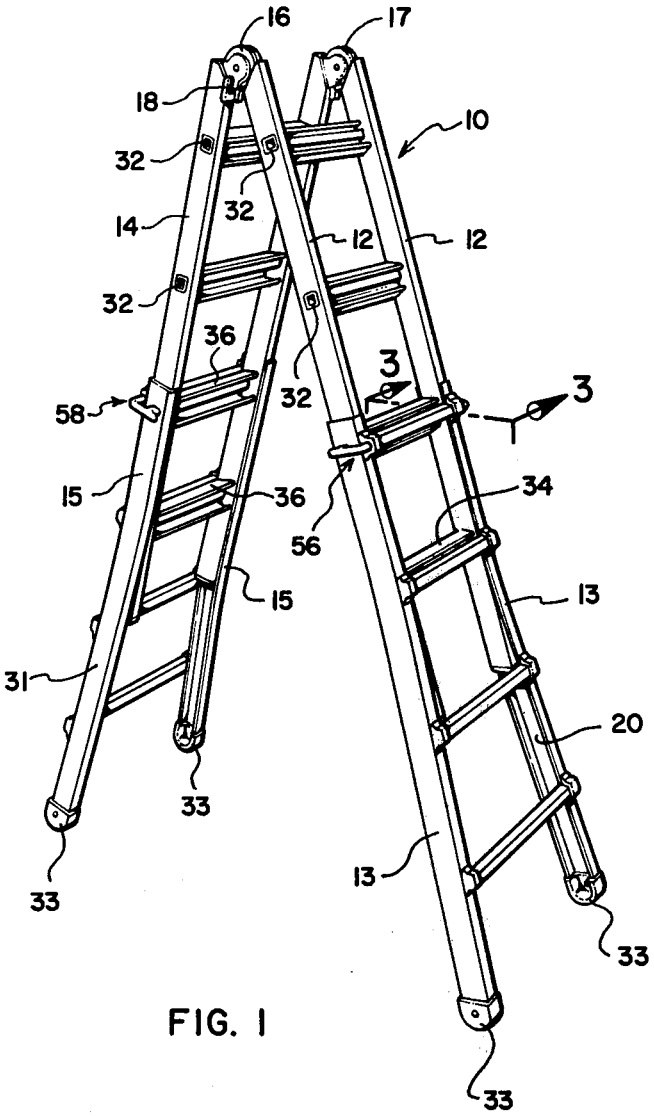
FIG. 1 is a perspective illustration of the combination step and extension ladder of the present invention folded into the step ladder configuration, and partially extended.

The invention is best understood by reference to the drawing wherein like parts have like numerals throughout.

In FIG. 1, the combination step and extension ladder generally designated 10 is shown folded in the step ladder configuration. Ladder 10 is constructed from four pairs of side rails 12–15. As will be hereinafter more fully described, side rail pairs 12 and 14 are hingedly connected at one end by hinges 16 and 17. At their other end side rail pairs 12 and 14 are each slidably mounted in telescopic relation within side rail pairs 13 and 15 respectively. Although each of the side rail pairs 12–15 could be made from any suitable wood or metal material, side rail pairs 12–15 of the illustrated embodiment are preferably formed from extruded aluminum because of its light weight, strength and durability.

Side rails 13 and 15 are each bent outwardly at their bottom, as shown at 31, to increase the width of side rail pairs 13 and 15 at their base, thus improving the ladder's stability. Non-skid rubber shoes 33 are rivited onto the surface-engaging ends of side rails 13 and 15 to prevent the ladder from slipping when in an upright position.

Figure 3:
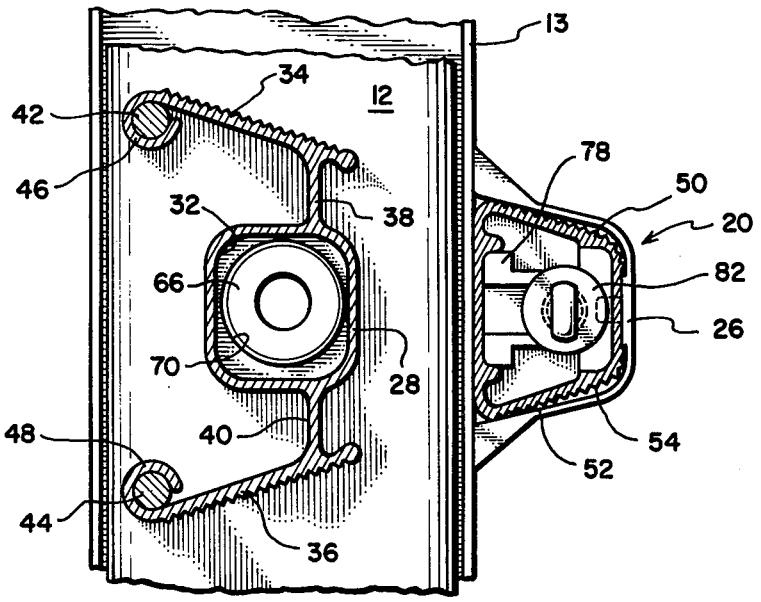
FIG. 3 is a cross section of one of the ladder rungs taken along line 3—3 of FIG. 1.

Hinges 16 and 17 which connect side rail pairs 12 and 14 contain a spring-loaded locking mechanism (not shown) which permits the combination step and extension ladder to be locked into any of several positions. For example, by rotating levers 18 and 19 of the hinges 16 and 17, the locking mechanism (not shown) is released and the ladder 10 may be unfolded and then relocked into the straight extension ladder position as shown in FIG. 3. Ladder 10 may also be folded so that the side rail pairs 12 and 13 lay flat against side rail pairs 14 and 15 when it is desired to store the ladder 10 in a closet. Hinges such as those illustrated in the preferred embodiment are available through Little Giant Industries, Inc., 31 West 100 South, American Fork, Utah. Other types of hinges which have been used in combination step and extension ladders are also known in the art and clearly, any suitable type of hinge could be substituted for hinges 16 and 17.

With continued reference to FIGS. 1 and 3, side rail pairs 12 and 14 are telescopically mounted within side rail pairs 13 and 15 respectively. Each of the side rails of side rail pairs 13 and 15 are aluminum and are extruded so as to form a U-channel as illustrated at 20. The U-channels formed in side rails 13 and 15 slidably receive the rails of side rail pairs 12 and 14. As will be hereinafter more fully described, each of the side rail pairs 12 and 14 may be independently telescopically extended in either of the step ladder (see FIG. 1) or extension ladder (see FIG. 2) configurations. It will thus be appreciated that by providing for independent extension of either of the side rail pairs 12 or 14, a step ladder of varying heights and varying angles can be formed, thus increasing the versatility of the ladder 10.

Figure 5:
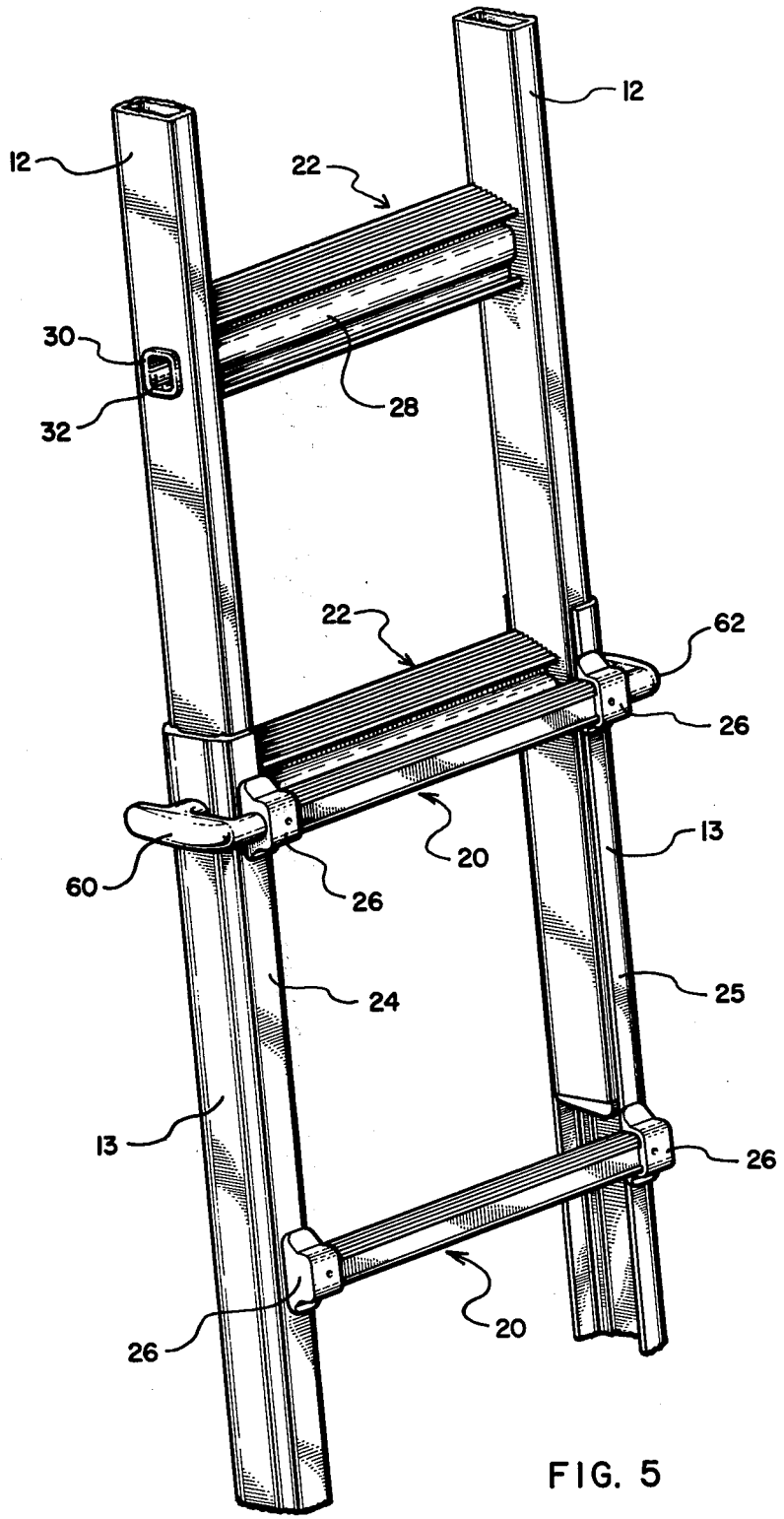
FIG. 5 is a fragmentary perspective illustration particularly showing the construction of the ladder rungs of the combination step and extension ladder.

Of particular importance with respect to the combination step and extension ladder of the present invention is the manner of construction of the ladder rungs. As shown best in FIG. 5, two sets of ladder rungs generally designated 20 and 22 are provided. Ladder rungs 22 are mounted between side rails 12 and 14 while ladder rungs 20 are mounted between side rails 13 and 15. As shown in FIG. 5, ladder rungs 20 are welded or otherwise suitably joined to the outside surfaces 24 and 25 of side rails 13 in order to permit telescopic extension of side rails 12 and ladder rungs 22 mounted therebetween. Protective plastic end covers 26 are snapped onto each of the ends of rungs 20 in order to protect persons working around the ladder from the sharp edges and corners of the rungs 20.

Each of the ladder rungs 22 has a tubular bar 28 (see also FIG. 3) which extends between the side rails 12. The tubular bar 28 is long enough to extend through holes (not shown) provided in side rails 12. Each of the ends of the tubular bar 28 are then swaged as illustrated at 30 in order to secure the ladder rung 22 between side rails 12. Furthermore, since the tubular bar 28 is hollow (see also FIG. 3), holes 32 are formed along the outside surfaces of side rails 12. As hereinafter more fully described, holes 32 provide incremental positions at which the side rails 12 may be locked when telescopically extending the side rails 12.

With particular reference to FIG. 3, it will be seen that ladder rungs 22 are extruded so as to form a ladder rung which has two flat stepping surfaces 34 and 36. As shown in FIG. 3, stepping surface 34 faces upwardly while stepping surface 36 faces downwardly. Each of the stepping surfaces are integrally joined at one end to the tubular bar 28 by brackets 38 and 40. At their other ends, stepping surfaces 34 and 36 are supported by rods 42 and 44 which extend from the side rails 12. Ends 46 and 48 of stepping surfaces 34 and 36 are bent so that they wrap around the rods 42 and 44 thus ensuring secure attachment thereto.

Importantly, it will be seen that stepping surfaces 34 and 36 are symmetrically angularly mounted between the side rails 12. Thus, for example, when the side rails 12 are vertically oriented as in FIG. 3, stepping surfaces 34 and 36 angle upwardly and downwardly respectively. However, when side rails 12 are inclined, as for example when the ladder is folded into the step ladder configuration (see FIG. 1) or inclined as a straight extension ladder (see FIG. 2), at least one of the stepping surfaces 34 or 36 will be essentially horizontally oriented depending upon whether stepping surface 34 faces upwardly or whether stepping surface 36 faces upwardly.

Figure 2:
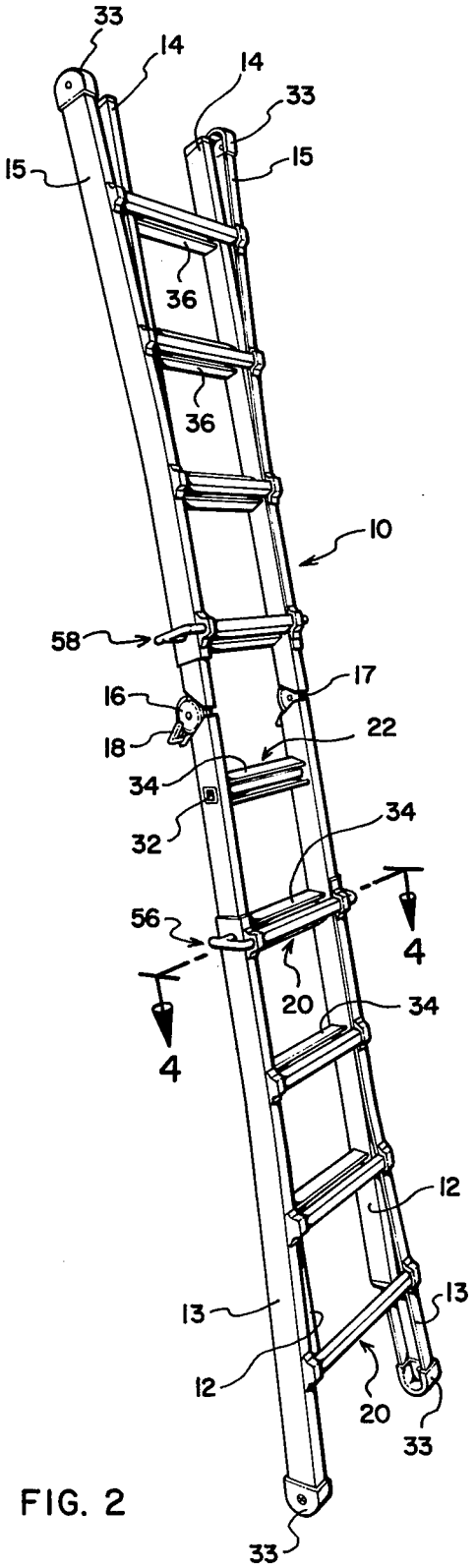
FIG. 2 is a perspective illustration of the combination step and extension ladder when unfolded and partially extended in the extension ladder configuration.

The symmetrical angular orientation of stepping surfaces 34 and 36 is extremely advantageous for several reasons. For example, when the ladder is folded into a step ladder configuration as shown in FIG. 1, the stepping surfaces 34 will provide horizontal stepping surfaces on one side of the ladder while the stepping surfaces 36 will likewise provide horizontal stepping surfaces on the other side of the ladder. Similarly, when the ladder is unfolded and inclined as an extension ladder as shown in FIG. 2, either stepping surfaces 34 or stepping surfaces 36 will provide an essentially horizontal stepping surface. For example, as shown in FIG. 2 stepping surfaces 34 are horizontal. If the ladder of FIG. 2 were to be turned on its other end, stepping surfaces 36 would form the horizontal stepping surfaces.

With continued reference to FIG. 3, it will be seen that the ladder rungs 20 which are mounted to the outher edges 24–25 of side rails 13 and 15 each have a generally trapezoidal cross-sectional shape, being extruded in the form of a tubular bar. Stepping surfaces 50 and 52 are angled so as to be essentially coplanar with the stepping surfaces 34 and 36 of the ladder rungs 22. As shown in FIG. 5, it will therefore readily be seen that when vertically aligned, ladder rungs 20 and 22 jointly form upper and lower stepping surfaces which are coplanar and which are angularly oriented with respect to the side rail pairs 12–14 so that whenever the ladder is placed in an upright position, either in the step ladder configuration or in the straight extension ladder configuration, a horizontal stepping surface will be formed by the stepping surfaces 34 and 50, or 36 and 52, of the two ladder rungs 20 and 22. Serrations such as that illustrated at 54 are formed on each of the stepping surfaces 34, 36, 50 and 52 to prevent slipping.

As previously indicated, side rail pairs 12 and 14 may be extended and locked in increments which correspond to the holes 32 formed along the outer edges of side rail pairs 12 and 14. As will be hereinafter more fully described, locking mechanisms generally designated 56 and 58 are mounted on side rail pairs 13 and 15. Each of the locking mechanisms 56 and 58 are identical and therefore for ease of illustration only locking mechanism 56 will be described.

Figure 4:
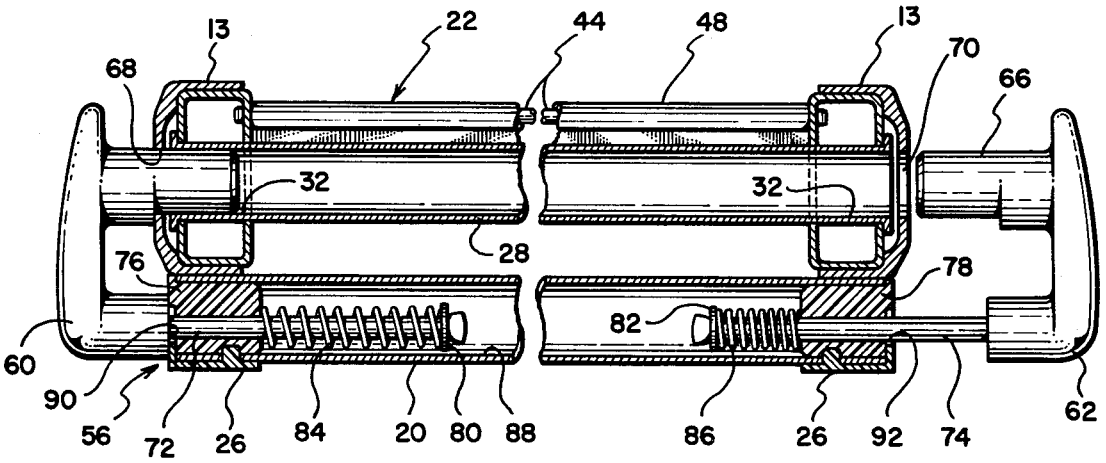
FIG. 4 is a cross section taken along line 4—4 of FIG. 1.

With reference to FIG. 4, it will be seen that locking mechanism 56 has two handles 60 and 62. Handles 60 and 62 have pins 64 and 66 which project through openings 68 and 70 in side rails 13 so as to engage holes 32 formed in the outer edges of side rails 12. Shafts 72 and 74 extend from handles 60 and 62 through openings 90 and 92 provided in end caps 26 and into the hollow 88 of ladder rung 20. Shafts 72 and 74 project through nylon grommets 76 and 78. Nylon grommets 76 and 78 are secured by retaining pins 77 and 79 formed on end caps 26. Flanges 80 and 82 are formed at the ends of shaft 72 and 74 for purposes of retaining springs 84 and 86 as described further below.

As shown by handle 60 at the left hand of FIG. 4, spring 84 pushes at one end against the nylon grommet 76 and pushes against the flange 80 of shaft 72 at the other end. Since the grommet 76 is secured by retaining pin 77, spring 84 exerts a force on flange 80 which causes the pin 64 of handle 60 to remain locked within the opening 32 in side rail 14. When it is desired to release the locking mechanism so as to permit telescopic extension of the side rails 14, the handle is pulled out as illustrated by handle 62 on the right side of FIG. 4. When handle 62 is pulled out, spring 86 is compressed between the nylon grommet 78 and the flange 82 at the end of shaft 74 so as to permit the pin 66 to be withdrawn from the opening 32 in the side rail 14. With handles 60 and 62 pulled out in this manner, side rails 14 are then advanced to the next rung and so on until the proper rung is reached where it is desired to lock the side rails 14. Handle 62 is then simply released and the spring 86 forces the shaft 74 and pin 66 back into the locked position as illustrated by handle 60. As can be readily seen from FIGS. 1 and 2, side rail pairs 12 and 14 can both be independently released and locked. This advantageously permits the ladder 10 to be extended both when it is in the step ladder configuration and when it is in the extension ladder configuration.

From the foregoing description, it should be noted that the combination step and extension ladder of the present invention provides an improved ladder rung having at least two flat stepping surfaces symmetrically oriented such that at least one of the stepping surfaces will present an essentially horizontal stepping surface regardless of whether the ladder is used in the step ladder configuration or the extension ladder configuration and regardless of which end of the side rails the ladder stands on. Furthermore, the combination step and extension ladder of the present invention can be extended while in either of the step or extension ladder configurations.

The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. In a ladder having a first pair of side rails slidably mounted in telescopic relation within a second pair of side rails, a plurality of improved ladder rungs, each rung comprising:

a first tubular bar joined at the ends thereof to the side rails of said slidably mounted first side rail pair;

at least two flat stepping surfaces each of which is integrally joined at one end to said bar by a bracket formed between said bar and the flat stepping surface joined thereto, each said stepping surface being supported at the other end by a rod extending from the side rails of said first side rail pair through a bend formed in the end of said stepping surface, said stepping surfaces being essentially symmetrically angularly disposed between said first side rail pair such that at least one of said stepping surfaces will be essentially horizontally oriented whenever the ladder is placed in an upright position; and a second tubular bar joined at the ends thereof to the side rails of said second side rail pair, the upper and lower surfaces of said second bar being configurated to form flat stepping surfaces that are essentially coplanar with the stepping surfaces joined to said first bar, said second bar being mounted to the second side rail pair so as to permit telescopic extension of the first side rail pair.

* * * * *

UNITED STATES PATENT AND TRADEMARK OFFICE

CERTIFICATE OF CORRECTION

PATENT NO. : 4,182,431

DATED : January 8, 1980

INVENTOR(S) : HAROLD R. WING

It is certified that error appears in the above-identified patent and that said Letters Patent are hereby corrected as shown below:

In the title, after "LADDER", insert --AND LADDER--

Column 1, line 2 of title, insert --AND LADDER-- before "RUNGS"

Column 1, line 17, "imossible" should be --impossible--

Column 4, line 66, "outher" should be --outer--.

Signed and Sealed this

*Twenty-ninth* Day of *April 1980*

[SEAL]

*Attest:*

SIDNEY A. DIAMOND

*Attesting Officer*

*Commissioner of Patents and Trademarks*